US007596829B2

(12) United States Patent
Song et al.

(10) Patent No.: US 7,596,829 B2
(45) Date of Patent: Oct. 6, 2009

(54) VACUUM CLEANER

(75) Inventors: Hwa-gyu Song, Gwangju (KR); Sung-cheol Lee, Gwangju (KR); Hyun-jun Oh, Gwangju (KR)

(73) Assignee: Samsung Gwangju Electronics Co., Ltd. (KR)

( * ) Notice: Subject to any disclaimer, the term of this patent is extended or adjusted under 35 U.S.C. 154(b) by 542 days.

(21) Appl. No.: 11/367,342

(22) Filed: Mar. 6, 2006

(65) Prior Publication Data

US 2006/0260091 A1 Nov. 23, 2006

(30) Foreign Application Priority Data

May 18, 2005 (KR) ..... 10-2005-0041441

(51) Int. Cl.
*A47L 9/00* (2006.01)

(52) U.S. Cl. ..... 15/326; 15/327.7

(58) Field of Classification Search ..... 15/326, 15/327.7

See application file for complete search history.

(56) References Cited

U.S. PATENT DOCUMENTS

| | | | | |
|---|---|---|---|---|
| 2,107,819 A | | 2/1938 | Faber | |
| 3,866,263 A | | 2/1975 | Crouser et al. | |
| 4,970,753 A | | 11/1990 | Herron, Jr. | |
| 5,293,664 A | * | 3/1994 | Lim et al. | 15/326 |
| 5,365,633 A | * | 11/1994 | Sunagawa et al. | 15/326 |
| 5,720,074 A | * | 2/1998 | Lee | 15/326 |

FOREIGN PATENT DOCUMENTS

| | | | |
|---|---|---|---|
| DE | 1628835 | | 6/1971 |
| DE | 3815320 | | 11/1989 |
| DE | 196 16 156 C1 | | 10/1997 |
| DE | 19843719 | | 4/1999 |
| EP | 0636336 | * | 7/1994 |
| EP | 0 636 336 B1 | | 3/1998 |

(Continued)

OTHER PUBLICATIONS

Korean Intellectual Property Office, Official Action dated Aug. 29, 2006, issued with respect to Korean Patent Application No. 2005-41441 filed on May 18, 2005.

(Continued)

*Primary Examiner*—Joseph J Hail, III
*Assistant Examiner*—Shantese McDonald
(74) *Attorney, Agent, or Firm*—Blank Rome LLP

(57) ABSTRACT

A vacuum cleaner is disclosed which comprises a motor chamber for mounting a motor assembly that, generates a suction force at a dust suction port, and a discharge port for guiding an air discharged from the motor chamber to the outside of a cleaner body, wherein the motor chamber comprises an air discharge opening which is in fluid communication with the discharge port; and a path extension member disposed between the motor assembly and the air discharge opening, of which edges are spaced apart from an inner wall of the motor chamber by a predetermined distance, respectively, to thereby form a detour path, and the air discharged from the motor assembly is guided in a circuitous manner by the path extension member so as to be passed through the detour path before reaching the air discharge opening. That assembly effectively reduces noise generated during operation of the motor assembly that is detectable outside of the cleaner body.

15 Claims, 4 Drawing Sheets

FOREIGN PATENT DOCUMENTS

| | | | |
|---|---|---|---|
| JP | 53-38164 | | 4/1978 |
| JP | 1993-004398 | | 3/1993 |
| JP | 1994-006209 | | 9/1994 |
| JP | 7-124081 | | 5/1995 |
| JP | 07-136083 | | 5/1995 |
| KR | 1019950012122 | | 10/1995 |
| SU | 1701266 | A1 | 12/1991 |
| SU | 1729479 | A1 | 4/1992 |

OTHER PUBLICATIONS

Russian Patent Office, Office Action issued Jun. 13, 2007 with respect to Russian Patent Application No. 2006114455 filed on Apr. 28, 2006.

* cited by examiner

VACUUM CLEANER

CROSS-REFERENCE TO RELATED APPLICATIONS

This application claims benefit under 35 U.S.C. § 119(a) of Korean Patent Application No. 2005-41441, filed May 18, 2005, the entire contents of which are incorporated herein by reference.

BACKGROUND OF THE INVENTION

1. Field of the Invention

The present invention relates to vacuum cleaners. More particularly, the present invention relates to a motor chamber of a vacuum cleaner, which is formed in a cleaner body for mounting a motor assembly that generates a suction force.

2. Description of the Related Art

Generally, vacuum cleaners include a motor assembly that generates a suction force at a suction port for drawing in impurities (hereinafter, referred to as 'dust') on a surface being cleaned together with ambient air. The motor assembly comprises a suction fan unit having a suction fan, and a motor body rotating the suction fan unit. The motor body has therein a stator, and a rotor rotated by electromagnetic interaction with the stator and thereby rotating the suction fan.

In the conventional motor assembly as described above, operating noise is generated due to airflow and vibrations induced by rotation of the suction fan. The operating noise is transmitted to the outside of a cleaner body together with the air being discharged, thereby making a user of the vacuum cleaner feel uncomfortable. Especially, such a noisy vacuum cleaner would be restricted in a place requiring quietness. The problem of operating noise becomes more serious in a vacuum cleaner having a high-speed suction motor rotating the suction fan at high speed for higher cleaning efficiency.

SUMMARY OF THE INVENTION

An aspect of the present invention is to solve at least the above problems and/or disadvantages and to provide at least the advantages described below. Accordingly, an aspect of the present invention is to provide an improved vacuum cleaner that effectively reduces operating noise generated by a motor assembly during operation of the vacuum cleaner from being transmitted to the outside of the vacuum cleaner.

In order to achieve the above-described aspects of the present invention, there is provided a vacuum cleaner comprising a motor chamber for mounting a motor assembly that generates a suction force at a dust suction port, and a discharge port for guiding an air discharged from the motor chamber to the outside of a cleaner body, wherein the motor chamber comprises an air discharge hole that is in fluid communication with the discharge port; and a path extension member disposed between the motor assembly and the air discharge opening, the sides of which are apart from an inner wall of the motor chamber by a predetermined distance, respectively, to thereby form detour paths, and the air discharged from the motor assembly is guided in a circuitous manner by the path extension member so as to be passed through the detour paths before reaching the air discharge opening.

Accordingly, since the air discharged from the motor assembly is guided in a circuitous manner by the path extension member so as to be passed through the detour paths before reaching the air discharge hole, operating noise generated during operation of the motor assembly that is transmitted to the outside of the cleaner body is effectively reduced.

The distance between the inner wall of the motor chamber and the respective sides of the path extension member is shorter than a distance between the inner wall of the motor chamber and the air discharge opening. Accordingly, the air discharged from the motor assembly and advancing to the air discharge opening is passed through the detour path in a circuitous manner, thereby more effectively reducing the operating noise.

The motor chamber comprises a first partition having an air suction opening connected to the dust suction opening and disposed in the cleaner body; a second partition having an air discharge opening and disposed in the cleaner body between the first partition and the discharge opening; and a path extension member is a third partition being connected to a first support member extended from the second partition and distanced from the second partition by a predetermined distance. By thus forming a predetermined path between the second and the third partitions, the air discharged from the motor assembly can be guided in a circuitous manner through the detour path and the predetermined path. Accordingly, transmission of the operating noise can be effectively reduced.

The second partition is removably inserted in a slide groove formed on an inner wall of the cleaner body.

In addition, the motor assembly comprises a suction motor, and a motor housing enclosing the suction motor, whereby the motor housing comprises at least one first penetrating opening formed on a rear side thereof that faces the third partition to pass the air discharged from the suction motor therethrough, wherein the distance between the edge of the third partition and the inner wall of the motor chamber is shorter than a distance between the first penetrating opening and the inner wall of the motor chamber. Therefore, when the air discharged through the first penetrating opening flows toward the detour path, the flowing path needs to be altered by the third partition, so that noise transmission is effectively reduced.

The motor housing comprises a first protrusion member protruding toward the third partition, and the third partition comprises a support groove for insertingly supporting the first protrusion member. Accordingly, since the path extension member also functions as a support for a rear side of the motor assembly, the structure of the motor chamber can be simplified.

The motor housing comprises a second protrusion member insertedly supporting the air suction opening when being mounted, and having a second penetrating opening through which the air drawn into the suction motor is passed. At least one of the first and the second protrusion members comprises a vibration prevention member. A vibration prevention member is provided at least between the first support member and the second partition or between the first support member and the third partition. Therefore, contact between the motor housing and the inside of the motor chamber is prevented. Also, the vibration prevention members effectively reduce vibration from being transmitted to the cleaner body.

The third partition comprises a second support member extended from a lower edge of the third partition facing a bottom surface of the motor chamber and contactingly supporting the bottom surface of the motor chamber. Thus, the third partition is firmly supported by the first and the second support members, which supports the motor assembly more securely.

The motor housing comprises an inner housing enclosing the motor body at a predetermined distance and thereby forming a first path, and an outer housing enclosing the inner housing at a predetermined distance, thereby forming a second path, and enclosing the suction fan unit. The inner housing comprises at least one connection opening formed near the suction fan unit to form the first and the second paths, and the outer housing comprises at least one penetrating opening formed on a rear side thereof facing the path extension member. The air drawn in through the suction fan unit and discharged through the motor body is passed sequentially through the first path, the connection opening, the second path, and the first penetrating opening before being discharged to the outside of the motor housing. Accordingly, the noise transmitted from the motor housing to the motor chamber can be effectively reduced.

Here, when a first noise-absorption member is formed on a surface of the path extension member and a second noise-absorption member on a surface of the second partition, the noise generated by collision of the air with the second partition and the path extension member and transmitted to the surfaces of the second partition and the path extension member can be diffused. As a result, the noise transmission can be effectively reduced.

BRIEF DESCRIPTION OF THE DRAWING FIGURES

The above aspect and other features of the present invention will become more apparent by describing in detail exemplary embodiments thereof with reference to the attached drawing figures, wherein.

DETAILED DESCRIPTION OF THE EXEMPLARY EMBODIMENTS

Figure 1:
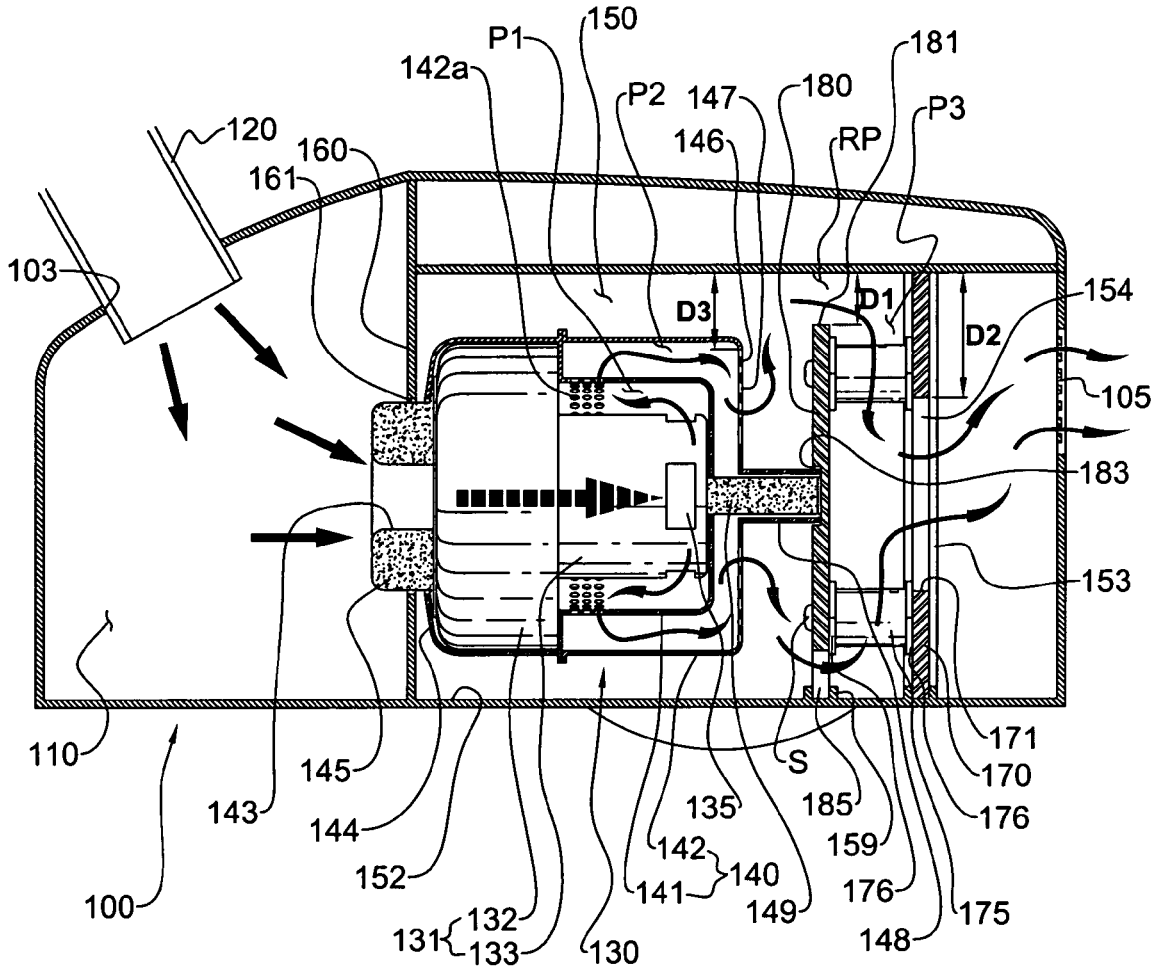
FIG. 1 is a sectional view schematically showing an inside of a vacuum cleaner according to a first embodiment of the present invention.

Hereinafter, certain embodiments of the present invention will be described in detail with reference to the accompanying drawing figures.

In the following description, same drawing reference numerals are used for the same elements even in different drawings. The matters defined in the description such as a detailed construction and elements are nothing but the ones provided to assist in a comprehensive understanding of the invention. Thus, it is apparent that the present invention can be carried out without those defined matters.

Figure 2:
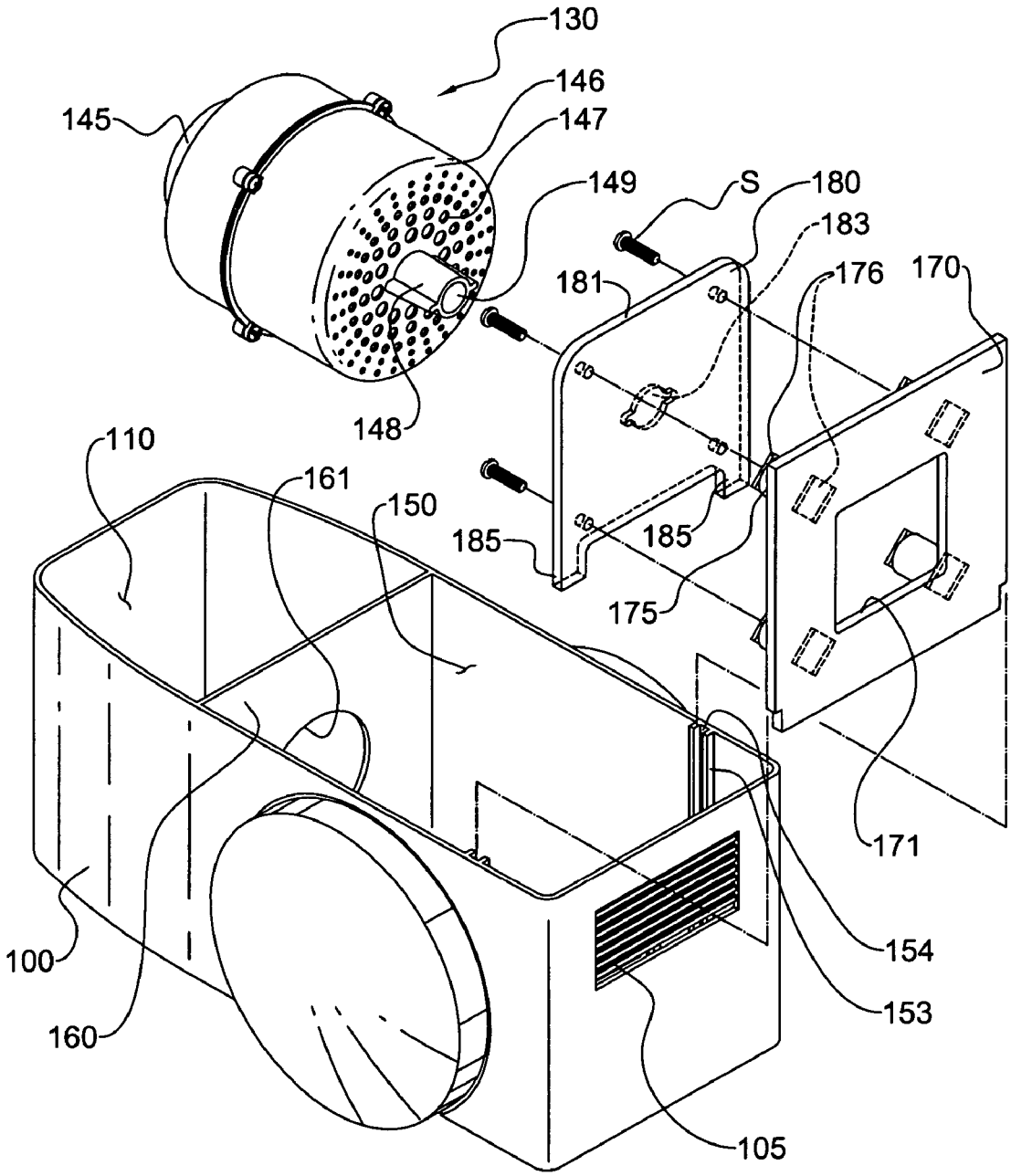
FIG. 2 is an exploded, perspective view of the vacuum cleaner according to the first embodiment of the present invention.

FIGS. 1 and 2 show a portion of a vacuum cleaner according to a first embodiment of the present invention. The vacuum cleaner according to the first embodiment of the present invention comprises a cleaner body 100 and a suction assembly (not shown). A dust suction port (not shown) is formed at a bottom part of the suction assembly so as to draw in dust-laden air around a surface being cleaned therethrough. As the cleaner body 100 is operated, the dust on the surface being cleaned is drawn in through the dust suction port together with the ambient air. When applied to an upright-type vacuum cleaner, the suction assembly may be pivotably connected to a lower end of the cleaner body. As shown in FIG. 1, when applied to a canister-type vacuum cleaner, the suction assembly is in fluid communication with the cleaner body 100 through a suction means such as an extension pipe (not shown) or an extension hose 120 connected with an insertion opening 103 penetratingly formed on the cleaner body 100.

The cleaner body 100 includes therein a motor assembly 130 generating a suction force at the dust suction port. The motor assembly 130 is mounted in a motor chamber 150 in the cleaner body 100. A dust collecting chamber 110 may be omitted in a vacuum cleaner having a separate dust collecting device such as a cyclone dust collector at the outside of the cleaner body 100. In this case, the vacuum cleaner will operate with the motor chamber 100 being in fluid communication with the insertion opening 103.

The motor chamber 150, in this embodiment, is disposed between first and second partitions 160 and 170. The first partition 160 comprises an air suction opening 161 which is in fluid communication with the insertion opening 103 through the dust collecting chamber 110. A second protrusion member 145 of a motor housing 140, that will be described hereinafter, is supportedly inserted in the air suction opening 161. The second protrusion member 145 comprises a second penetration opening 143 which is in fluid communication with a suction fan unit 132 of a suction motor 131 in the motor housing 140. Therefore, since a front part of the motor housing 140 is supported by connection between the second protrusion member 145 and the air suction opening 161, a dedicated structure formed in the motor chamber 150 used to support the front part of the motor housing 140 can be omitted.

The second partition 170 comprises an air discharge opening 171 which is in fluid communication with a discharge port 105 penetratingly formed on an outer circumference of the cleaner body 100. Accordingly, an air path for the air being discharged from the motor assembly 130 is temporarily narrowed and then expanded by the air discharge opening 171. Therefore, operating noise of the motor assembly 130 that is transmitted to the outside of the cleaner body 100 can be effectively reduced. As shown in FIG. 2, the second partition 170 is slidably engaged with a slide groove 154 formed by a plurality of first slide projections 153 formed on an inner circumference of the cleaner body 100. Therefore, the manufacturing process for forming the second partition 170 in the cleaner body 100 can be simplified.

The motor assembly 130 comprises the suction motor 131 and the motor housing 140 enclosing the suction motor 131. The suction motor 131 comprises the suction fan unit 132, which has a suction fan (not shown) for generating the suction force, and a motor body 133 for rotating the suction fan. The motor body 133 includes therein a stator (not shown), and a rotor (not shown) rotated by interaction with the stator and thereby rotating the suction fan. At least one penetration opening 135 is formed on a sidewall of the motor body 133 to discharge therethrough the air drawn into the suction fan unit 132. The motor housing 140 comprises the second protrusion member 145 formed on a front side 144 thereof, and a first protrusion member 148 formed on a rear side 146 thereof. The second protrusion member 145 is insertedly supported by the air suction hole 161 of the first partition 160, and the first protrusion member 148 by a support groove 183 of a third partition 180 that will be described hereinafter. A vibration prevention member 149 supporting a rotary shaft of the suction motor 131 is provided inside the first protrusion member 148. The second protrusion member 145 also comprises a predetermined vibration prevention member such as a robber (not shown). According to the above-described supporting structure of the motor housing 140, contact between a sidewall of the motor housing 140 and an inner wall of the motor chamber 150 can be reduced and as a result, vibration generated during operation of the suction motor 131 which is directly transmitted to the cleaner body 100 can be effectively reduced.

The motor housing 140 is configured to reduce transmission of the operating noise generated during operation of the suction motor 131 to the outside of the cleaner body 100. For this purpose, more particularly, the motor housing 140 comprises an inner housing 141 and an outer housing 142. The inner housing 141 encloses the motor body 133 at a predetermined distance, thereby forming a first path P1 between the motor body 133 and the inner housing 141. The outer housing 142 encloses the suction fan unit 132 of the suction motor 131 and the inner housing 141. The outer housing 142, therein, encloses the inner housing 141 at a predetermined distance, thereby forming a second path P2 between the inner and the outer housings 141 and 142. The second path P2 is connected to the first path P1 through a plurality of connection openings 142*a* formed at a part of the inner housing 141, in the vicinity of the suction fan unit 132. Also, the second path P2 is connected to the motor chamber 150 through a plurality of first penetration openings 147 formed on the rear side 146 of the motor housing 140. The first penetration openings 147 are preferably arranged in a radial manner on the rear side 146 of the motor housing 140, wherein the diameters of the first penetration openings 147 increase going toward the center of the motor housing 140. Therefore, the air discharged from the motor body 133 is guided in a circuitous manner to sequentially pass through the first path P1, the second path P2, the first penetration opening 147, and discharged into the motor chamber 150. Thus, since the path for the air being discharged from the suction motor 131 is extended sufficiently and circuitously within the motor housing 140, the operating noise of the suction motor 131 that is transmitted to the outside of the motor housing 140 can be effectively reduced.

Figure 3:
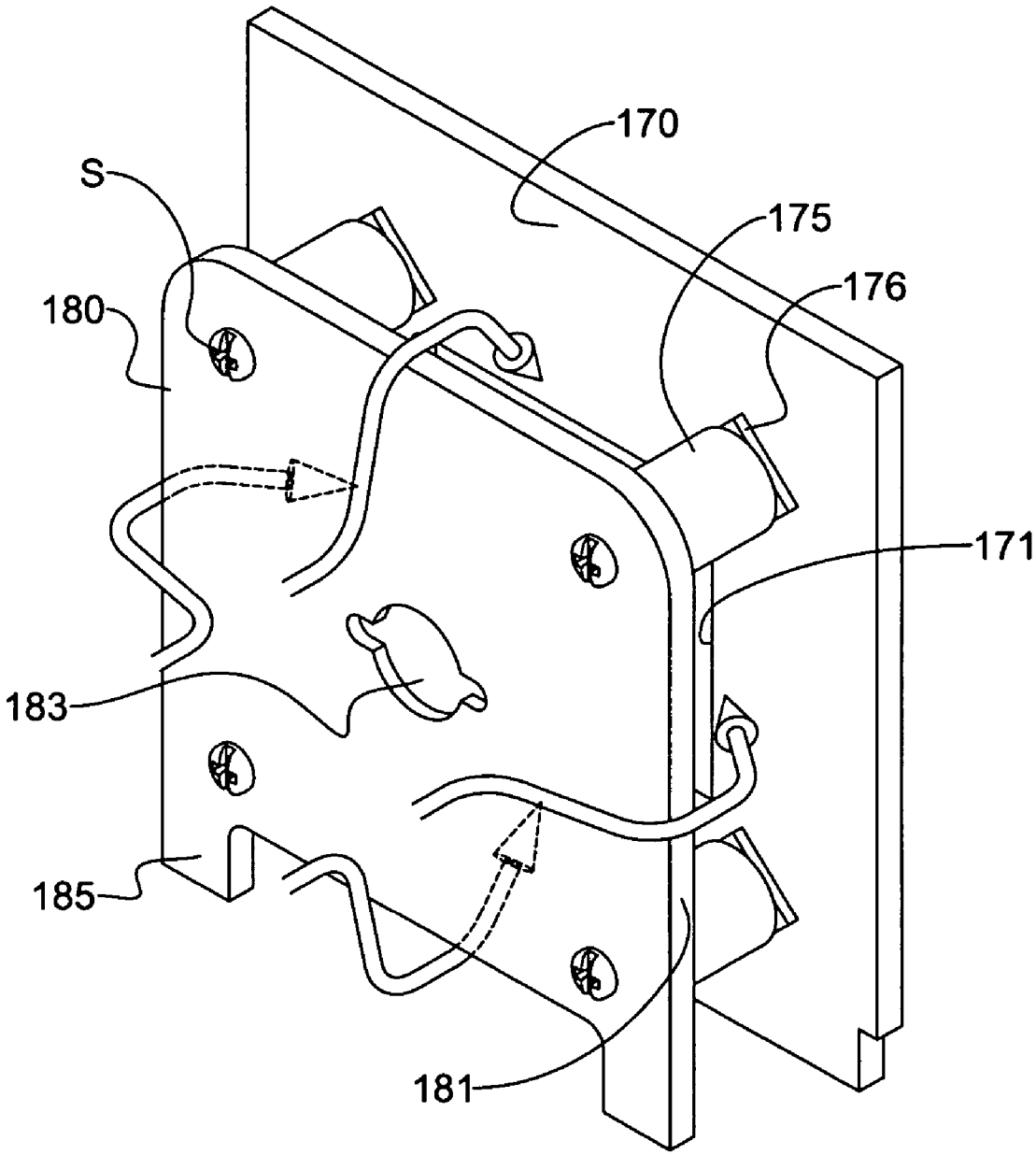
FIG. 3 is a perspective view extractingly showing a third partition from FIG. 1.

Preferably, the air discharged into the motor chamber 150 is guided in a circuitous manner up to the discharge port 105 so that the operating noise transmitted to the outside of the cleaner body 100 through the discharge port 105 can be effectively reduced. For this, a path extension member is employed between the second partition 170 and the motor assembly 130. In this embodiment, the third partition 180 is used as the path extension member. As shown in FIG. 3, the third partition 180 is at a predetermined distance apart from the second partition 170, thereby forming a third path P3 having a predetermined width between the second and the third partitions 170 and 180. In addition, edges 181 of the third partition 180 are apart from the inner wall of the motor chamber 150 by a predetermined distance, thereby forming detour paths RP between the inner wall of the motor chamber 150 and the edges 181. Preferably, a distance D1 between the edges 181 of the third partition 180 and the inner wall of the motor chamber 150 is shorter than a distance D2 between the air discharge opening 171 and the inner wall of the motor chamber 150. Preferably, the third partition 180 is disposed coaxially with the air discharge opening 171. Also preferably, the distance D1 is shorter than a distance D3 between outermost one of the plurality of first penetrating openings 147 formed on the rear side 146 of the motor housing 140 and the inner wall of the motor chamber 150. According to this configuration, the air discharged through the first penetrating openings 147 of the motor housing 140 is guided in a circuitous manner through the detour paths RP and the third path P3 and then discharged to the outside of the cleaner body 100 through the air discharge opening 171 and the discharge port 105. Therefore, the operating noise of the suction motor 131 transmitted through the discharge port 105 of the cleaner body 100 is effectively reduced. According to an embodiment of the present invention as described above, operating noise of almost all frequency bands can be effectively reduced from being transmitted out of the cleaner body 100. Especially, transmission of low-frequency noise, such as noise of no greater than 6000 Hz, can be more effectively reduced than noises of other frequencies. In addition, since the path extension member forming the detour paths RP and the third path P3 has a plate form, enough space for the air flowing around in the motor chamber 150 can be ensured, compared to when using dedicated pipe members or duct members for guiding the air being discharged from the motor assembly 130. Thus, the space for airflow is secured in the motor chamber 150 and as a result, overload of the motor assembly 130 can be prevented, which is caused by restricted airflow in the motor chamber 150 when the path extension member is used.

The third partition 180 is supported by first and second support members 175 and 185. The first support member 175 is formed as a member extending from the second partition 170 and has a predetermined length so that the third path P3 can be formed between the second and the third partitions 170 and 180. Vibration prevention members 176 formed at opposite ends of the first support member 175 reduce the vibration from the motor housing 140 up to the third partition 180 from being transmitted to the second partition 180 through the first support member 175. Although the first support member 175 and the third partition 180 are connected through a fastening screw S in this embodiment, they may be attached to each other by adhesive (not shown). In this case, vibration-preventing adhesive is more preferably used, and such connection methods may be applied for connection between the second partition 180 and the first support member 175. Meanwhile, the second support member 185 is extended from the edge 181 of the third partition 180 so as to be supported by a second slide projection 159 formed on a bottom surface 152 of the motor chamber 150 when mounting the third partition 180. When mounting the third partition 180, preferably, the detour path RP is also formed at a lower part of the third partition 180. According to the present embodiment, the second support members 185 are apart from each other by a predetermined distance, thereby forming the detour path RP therebetween.

Figure 4:
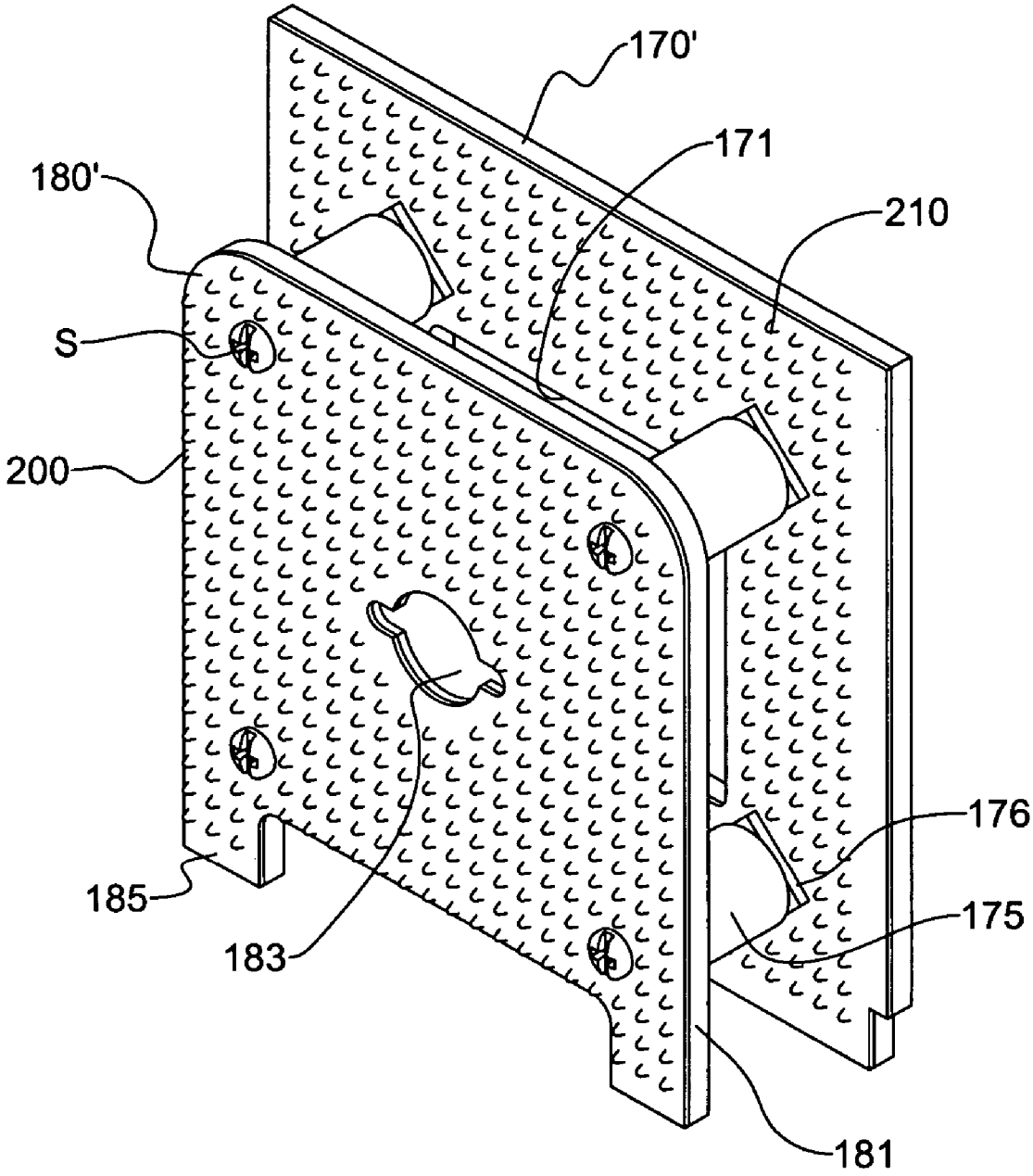
FIG. 4 is a perspective view showing a third partition according to a second embodiment of the present invention.

FIG. 4 shows second and third partitions according to a second embodiment of the present invention. The third partition 180' of the second embodiment comprises a plurality of first noise-absorption projections 200 formed on a surface thereof. Additionally, a plurality of second noise-absorption projections 210 having the same structure as the first noise-absorption projections 200 of the third partition 180 are formed on a surface of the second partition 170'. As the air flowing through the detour path RP and the third path P is contacted with the second partition 170' and the third partition 180', the first and the second noise-absorption projections 200 and 210 help diffuse the operating noise being transmitted together with the airflow, thereby effectively reducing the noise transmitted to the outside of the cleaner body 100.

Here, configuration of the surfaces of the second and the third partitions 170' and 180' is not limited to the noise-absorption projections 200 and 210. In other words, other various structures are applicable instead of the noise absorption projections 200 and 210; for example, a noise-absorption member (not shown) such as a sponge having good noise absorbing property may be layered on the surfaces of the second and the third partitions 170' and 180', respectively.

As described above, according to embodiments of the present invention, when the air discharged from the motor assembly 130 flows to the air discharge opening 171 of the motor chamber 150, the air is guided by the third partition 180 in a circuitous manner so as to pass through the detour path RP. Accordingly, the noise generated during operation of the suction motor that is transmitted to the outside of the cleaner body 100 through the discharge port 105 can be effectively reduced. Consequently, cleaning work can be performed more quietly.

Furthermore, because the third partition 180 supports the rear side of the motor housing 140 to prevent contact between the sidewall of the motor housing 140 and the inner wall of the motor chamber 150, installation of the motor housing 140 can be facilitated as well as effectively reducing the operating noise transmitted to the outside of the cleaner body 100 through the inner wall of the motor chamber 150.

While the invention has been shown and described with reference to certain embodiments thereof, it will be understood by those skilled in the art that various changes in form and details may be made therein without departing from the spirit and scope of the invention as defined by the appended claims.

What is claimed is:

1. A vacuum cleaner having a motor chamber inside a cleaner body for mounting a motor assembly that generates a suction force at a dust suction port, the cleaner body having a discharge port for guiding air discharged from the motor chamber to the outside of the cleaner body, the motor chamber comprising:

an air discharge opening in fluid communication with the discharge port; and a path extension member disposed between the motor assembly and the air discharge opening, wherein the edges of the path extension member are spaced apart from an inner wall of the motor chamber by a predetermined distance to thereby form a detour path, wherein the air discharged from the motor assembly is guided in a circuitous manner by the path extension member so as to be passed through the detour path before reaching the air discharge opening, wherein a distance between the inner wall of the motor chamber and the respective edges of the path extension member is less than a distance between the inner wall of the motor chamber and the air discharge opening, wherein the motor chamber further comprises a first partition having an air suction opening connected to the dust suction opening and disposed in the cleaner body; and a second partition having the air discharge opening and disposed in the cleaner body between the first partition and the discharge port, wherein the path extension member is a third partition being connected to a first support member extending from the second partition and spaced apart from the second partition by a predetermined distance, and wherein the second partition is removably inserted in a slide groove formed on a portion of an inner wall of the cleaner body.

2. The vacuum cleaner of claim 1, wherein the motor assembly comprises a suction motor and a motor housing enclosing the suction motor, and wherein the motor housing comprises at least one first penetrating opening formed on a rear side thereof that faces the third partition to pass the air discharged from the suction motor therethrough, and wherein a distance between the edges of the third partition and the inner wall of the motor chamber is less than a distance between the first penetrating opening and the inner wall of the motor chamber.

3. The vacuum cleaner of claim 1, wherein the motor assembly comprises a suction motor and a motor housing enclosing the suction motor, and wherein the motor housing comprises a first protrusion member extending toward the third partition, and wherein the third partition comprises an insertion support groove for supporting the first protrusion member.

4. The vacuum cleaner of claim 3, wherein the motor housing further comprises a second protrusion member supported by the air suction opening when being mounted, and having a second penetrating opening through which air drawn into the suction motor is passed.

5. The vacuum cleaner of claim 4, wherein at least one of the first and the second protrusion members comprises a vibration prevention member.

6. The vacuum cleaner of claim 1, wherein the third partition comprises a second support member extending from a lower edge of the third partition facing a bottom surface of the motor chamber and supported by the bottom surface of the motor chamber.

7. The vacuum cleaner of claim 1, further comprising a second noise-absorption member mounted on a surface of the second partition.

8. The vacuum cleaner of claim 1, wherein a vibration prevention member is provided at least one between the first support member and the second partition or between the first support member and the third partition or in both locations.

9. The vacuum cleaner of claim 1, wherein the motor assembly comprises a suction motor and a motor housing enclosing the suction motor, wherein the suction motor comprises a motor body and a suction fan unit generating the suction force, and wherein the motor housing comprises an inner housing enclosing the motor body at a predetermined location and thereby forming a first path, and an outer housing enclosing the inner housing at a predetermined location, thereby forming a second path, and wherein the inner housing encloses the suction fan unit, and wherein the inner housing comprises at least one connection opening formed near the suction fan unit to connect the first and the second paths, and wherein the outer housing comprises at least one first penetrating opening formed on a rear side thereof facing the path extension member, and wherein the air drawn in through the suction fan unit and discharged through the motor body is passed sequentially through the first path, the connection opening, the second path, the first penetrating opening and then discharged to the outside of the motor housing.

10. The vacuum cleaner of claim 1, further comprising a first noise-absorption member formed on a surface of the path extension member.

11. A vacuum cleaner having a motor chamber inside a cleaner body for reducing the noise generated by a motor assembly mounted in the motor chamber during operation of the vacuum cleaner, the motor chamber comprising:

a first partition disposed on one end of the cleaner body, the first partition having an air suction opening in fluid communication with a dust suction opening;

a second partition disposed in the cleaner body between the first partition and a discharge port, the second partition haying an air discharge opening, and a third partition connected to a first support member extending from the second partition and spaced apart from the second partition by a predetermined distance, wherein the edges of the third partition are spaced apart from an inner wall of the motor chamber by a predetermined distance to thereby form a detour path, wherein the air discharged from the motor assembly is guided in a circuitous manner by the third partition so as to be passed through the detour path before reaching the air discharge opening, and wherein the second partition is removably inserted in a slide groove formed on a portion of an inner wall of the cleaner body.

12. The vacuum cleaner of claim 11, wherein a distance between the inner wall of the motor chamber and the respective edges of the third partition is less than a distance between the inner wall of the motor chamber and the air discharge opening.

13. The vacuum cleaner of claim 11, wherein the motor housing includes at least one first penetrating opening formed on a rear side thereof that faces the third partition and wherein a distance between the edges of the third partition and the inner wall of the motor chamber is less than a distance between the first penetrating opening and the inner wall of the motor chamber.

14. The vacuum cleaner of claim 11, further comprising first and second extension members for absorbing vibrations produced by the motor assembly.

15. The vacuum cleaner of claim 14, further comprising a noise-absorption member mounted on a surface of the second partition or third partitions.

* * * * *

UNITED STATES PATENT AND TRADEMARK OFFICE

CERTIFICATE OF CORRECTION

PATENT NO. : 7,596,829 B2
APPLICATION NO. : 11/367342
DATED : October 6, 2009
INVENTOR(S) : Song et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 714 days.

Signed and Sealed this

Twenty-eighth Day of September, 2010

David J. Kappos

David J. Kappos
*Director of the United States Patent and Trademark Office*